US005483732A

United States Patent [19]

Wang

[11] Patent Number: 5,483,732

[45] Date of Patent: Jan. 16, 1996

[54] VARIABLE C-SHAPED RETAINING RING PLIERS

[76] Inventor: Tian S. Wang, No. 232, Doou Tarn Rd., Shaluh Town, Taichung Shiann, Taiwan

[21] Appl. No.: 318,026

[22] Filed: Oct. 4, 1994

[51] Int. Cl.[6] ..... B25B 7/12

[52] U.S. Cl. ..... 29/229; 81/424

[58] Field of Search ..... 81/421–424; 29/229, 29/225

[56] References Cited

U.S. PATENT DOCUMENTS

| | | | |
|---|---|---|---|
| 3,040,420 | 6/1962 | Kulp | 29/229 |
| 3,484,924 | 12/1969 | Dahl | 29/229 |
| 3,681,840 | 8/1972 | Pool | 29/229 |
| 5,079,977 | 1/1992 | Petrie | 81/423 |
| 5,203,241 | 4/1993 | Mattis | 81/424 |
| 5,327,802 | 7/1994 | Yu | 29/229 |

*Primary Examiner*—Robert C. Watson

[57] ABSTRACT

A variable pliers for clamping a C-shaped retaining ring comprises a main body, a pliers head, and two clamping rods. The main body is made up of two handles provided respectively at the front end thereof with a pivoting hole dimensioned to received therein a pivoting shaft. The pliers head comprises two clamping member, one of which is provided with a round protection having an axial hole dimensioned to receive therein the pivoting shaft. Another one of the two clamping members is provided with a through hole dimensioned to receive therein the round projection. The two clamping members are provided respectively with locating holes by means of which two clamping members are fastened with the main body in conjunction with the locating pins. The two clamping rods of an L-shaped construction are provided respectively at one end thereof with a threaded portion engageable with a fastening bolt and at another end thereof with a clamping tip for clamping a C-shaped retaining ring at various angles and in various directions.

2 Claims, 5 Drawing Sheets

VARIABLE C-SHAPED RETAINING RING PLIERS

FIELD OF THE INVENTION

The present invention relates generally to a pliers, and more particularly to a variable C-shaped retaining ring pliers which is provided with means enabling the pliers to work at various angles without the use of various pliers heads.

BACKGROUND OF THE INVENTION

The variable C-shaped retaining ring pliers of the prior art is provided with a plurality of pliers heads which enable the pliers to operate at various angles, such as 180 degrees, 90 degrees, and 45 degrees. It is therefore conceivably inconvenient to use such a prior art pliers as described above in view of the fact that the pliers user must keep changing the pliers heads when he or she is in a work situation calling for the use of the various pliers heads capable of operating at different angles. In addition, it is a rather irritating situation that a user of the prior art pliers has to look for a right pliers head in the midst of a work.

SUMMARY OF THE INVENTION

It is therefore the primary objective of the present invention to provide a variable C-shaped retaining ring pliers, which can be operated in various directions and at various angles and is composed of a main body, a pliers head and two clamping rods. The main body is made up of two handles provided respectively at the front end thereof with a pivoting hole dimensioned to fit over a pivoting shaft. The pliers head comprises two clamping members, one of which is provided with a round projection having centrally an axial hole dimensioned to fit over the pivoting shaft. Another one of the two clamping members is provided with a through hole dimensioned to fit over the round projection of the first clamping member, The two clamping members are provided respectively with locating holes by means of which the two clamping members are fastened with the main body in conjunction with the locating pins, The two clamping rods are similar in construction and have an L shape, Each of the two clamping rods is provided at one end thereof with a threaded portion engageable with the clamping member and is further prevailed at another end thereof with a clamping tip for clamping a C-shaped retaining ring at various angles and in various directions.

DETAILED DESCRIPTION OF THE INVENTION

Figure 1:
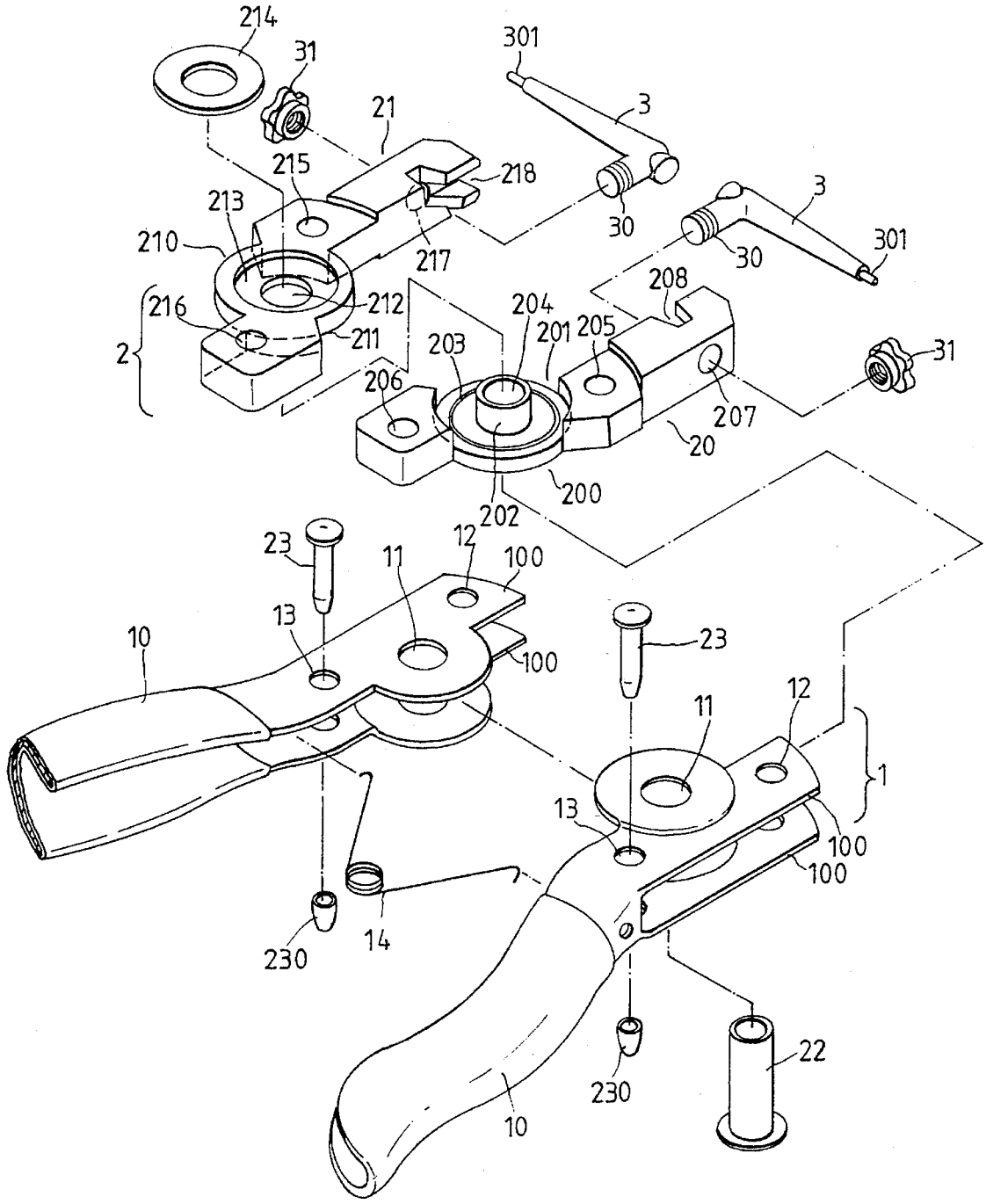
FIG. 1 shows an exploded view of the present invention.
Figure 2:
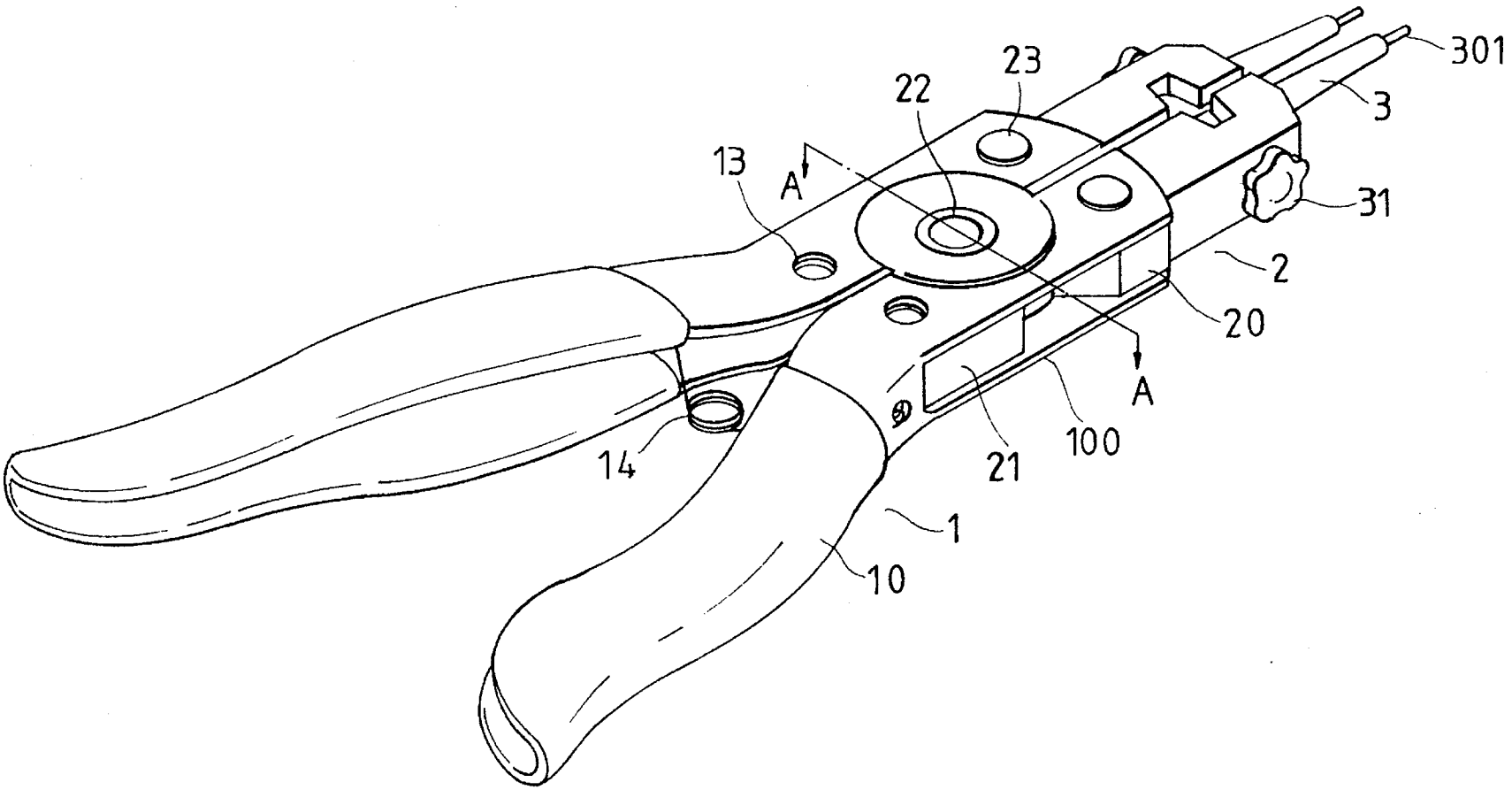
FIG. 2 is a schematic perspective view of the present invention in combination.

As shown in FIGS. 1 and 2, a variable pliers for clamping a C-shaped retaining ring comprises a main body 1, a pliers head 2 and two clamping rods 3.

The main body 1 is made up of two handles 10 similar in construction. The two handles 10 are provided respectively at the front end thereof with a clamping plate 100 having a center hole 11 and two locating holes 12 and 13 which are on opposite sides of the center hole 11. Located between the two handles 10 is an elastic element 14.

Figure 4:
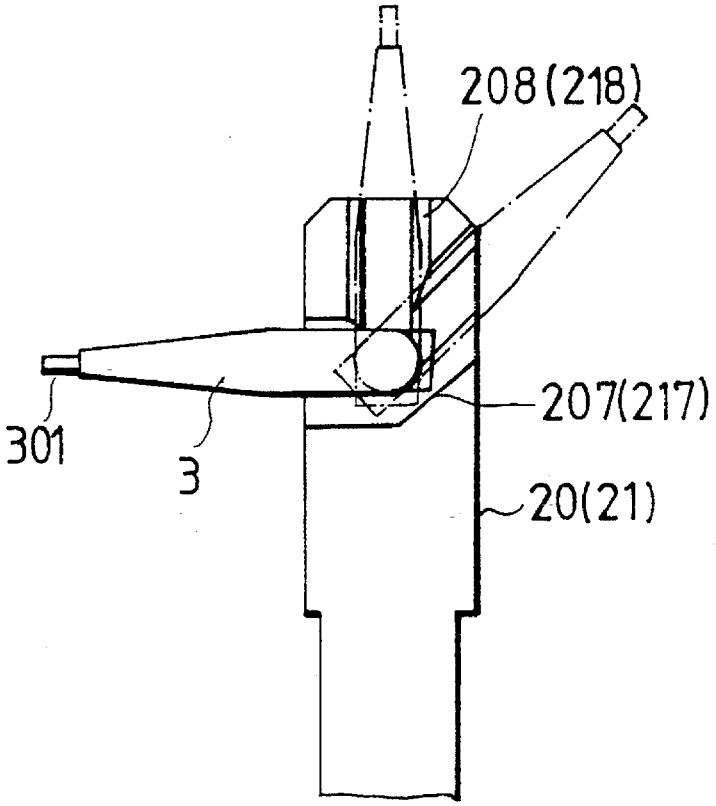
FIG. 4 shows a schematic view of the clamping member 15 which is fastened with the clamping rod.
Figure 3:
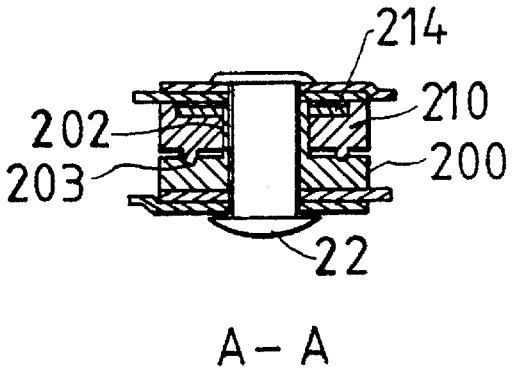
FIG. 3 shows a sectional view of the position of the pivoting shaft of the present invention.

The pliers head 2 is composed of two clamping members 20 and 21, which are provided respectively with pivoting portions 200 and 210. The pivoting portion 200 of the first clamping member 20 is provided with a slot 201 having centrally a round projection 202 and having peripherally a pro traded ring 203. The pivoting portion 210 of the second clamping member 21 is provided with, a slot 211 having centrally a through hole 212 corresponding in location to the round projection 202 of the first clamping member The through hole 212 of the second clamping member 21 is dimensioned to fit over the round projection 202 of the first clamping member The second cramping member 21 is further provided in the slot 211 with a washer receiving space 213 in which a washer 214 is disposed. The two clamping members 20 and 21 of the pliers head 2 are joined together by the round projection 202 which is fitted into the through hole 212. The protruded ring 203 of the first clamping member 20 serves to minimize the mechanical Friction between the pivoting portions 200 and 210 of the two clamping members 20 and 21. The round projection 202 is provided with an axial hole 204 corresponding in location to the center holes 11 of the main body 1. As shown in FIG. 3, the two handles 10 of the main body 1 are joined with two clamping members 20 and 21 of the pliers head 2 by means of a pivoting shaft 22 which is received in the center holes 11 of the main body 1 and the axial hole 204 of the pliers head 2. The two clamping members 20 arid 21 of the pliers head 2 provided respectively with locating holes 205, 206, 215 and 216, which are corresponding in location to the locating holes 12 and 13 of the main body 1. In other words, the main, body 1 and the pliers head 2 are further located by two locating pins 23 which are received respectively in the locating holes 12, 205, 215 and 13, 206, 216. Each of the two locating pins 23 is provided at the tail end thereof with a plastic cap 230 attached securely thereto for preventing the locating pin 23 From slipping off. The two clamping members 20 and 21 are provided radially and respectively at the front end thefore with fastening holes 207 and 217, which are opposite in location to each other and are of a radiate construction. The fastening holes 207 and 217 are provided respectively with rod slots 208 and 218, which enable the clamping rods 3 to be rotated are 45 degrees, 90 degrees and 180 degrees, as illustrated in FIG. 4.

The two clamping rods 3 of an L-shaped construction are similar in construction, shape and size. Each of the two camping rods 3 is provided at the :rear end thereof with a threaded portion. 30 which is received adjustable in the rod slot 208(or 218) of the fastening hole 207 or 217 and is engageable with a :fastening bolt 31. The two clamping rods 3 are provided respectively at-the front end thereof with a clamping tip 301 for clamping a C-shaped retaining ring.

Figure 5:
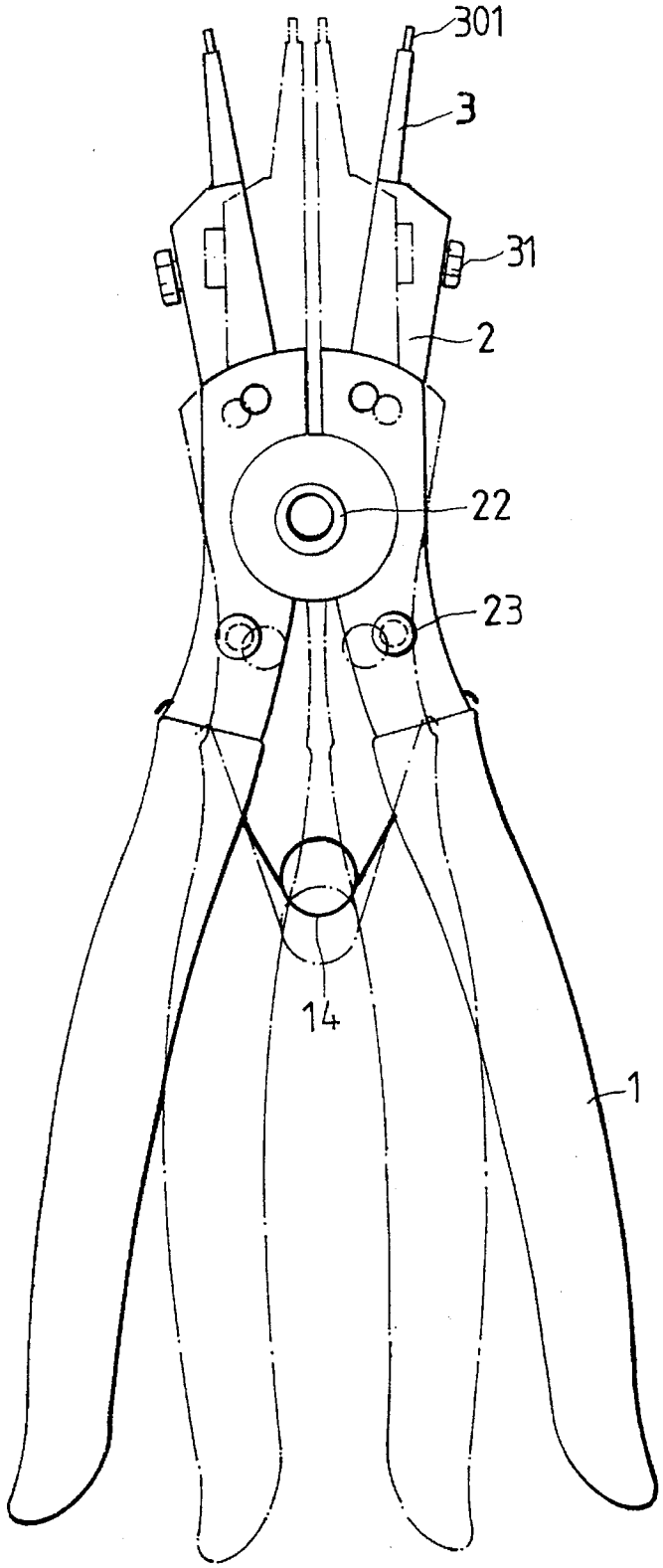
FIG. 5 is a schematic view of the present invention at work.
Figure 5A:
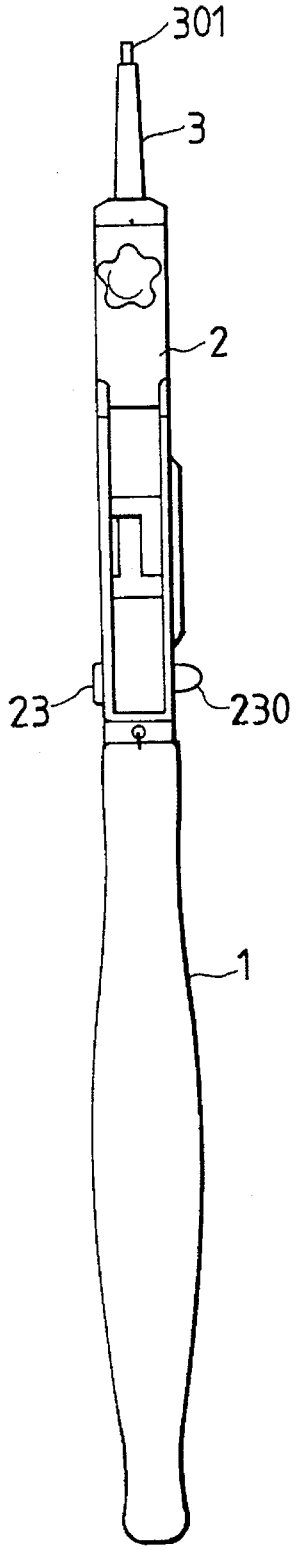
FIG. 5A is a side view of the present invention.
Figure 6:
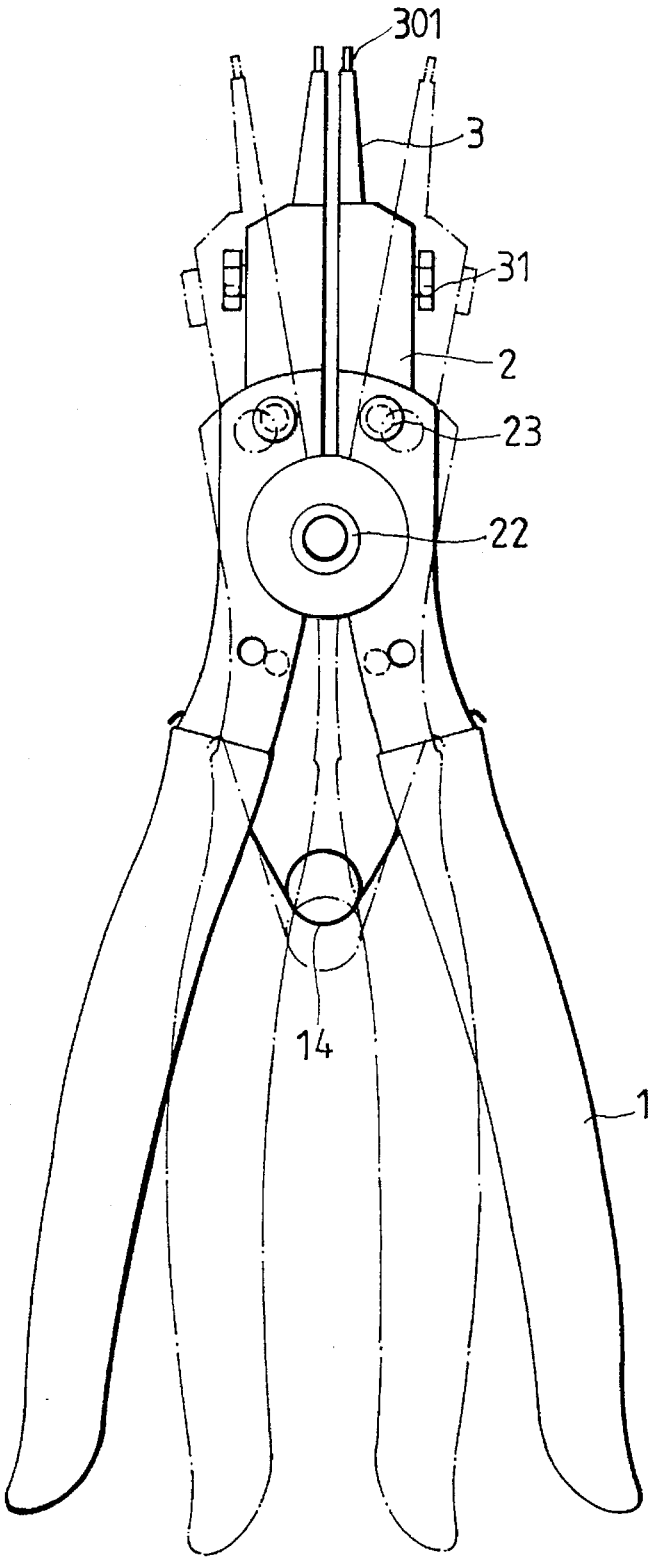
FIG. 6 shows another schematic view of the present invention is action.
Figure 6A:
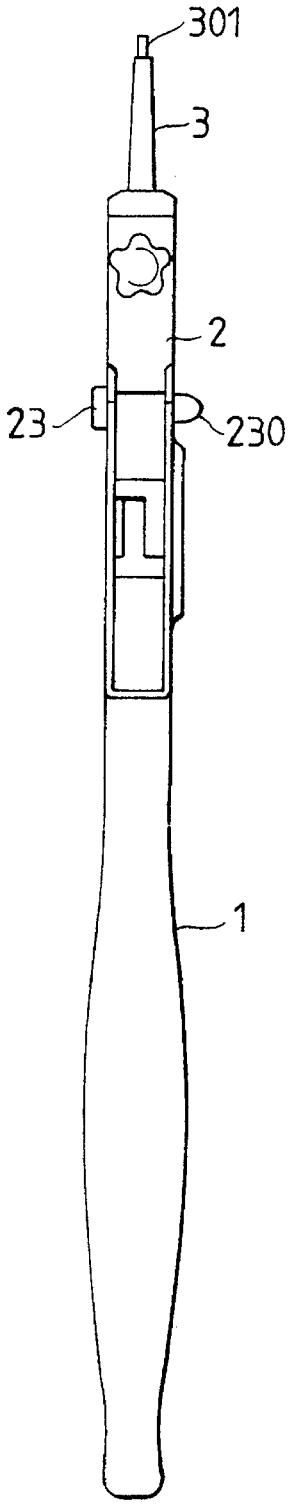
FIG. 6A is a side view of the present invention.

As shown in FIG. 5, when the pliers off the present invention is not in action, the two handles 10 of the main body 1 and the two clamping members 20 and 21 of the pliers head 2 remain apart in view of the fact that the two locating pins received in the locating holes 13 of the main body 1 and the through holes 206 and 216 of the two clamping members 20 and 21 of the pliers head 2. As two handles 10 are forced to move inwards in opposite directions, the two clamping members 20 and 21 are therefore caused to join together an the other hand, the locating pins 23 are received in the locating holes 12 of the main body 1 and the through holes 205 and 215 of the two clamping members 20 and 21.

As shown in FIG. 8, the two handles 1D of the main body 1 remain apart while the two clamping members 20 and 21 are still joined together. As the two handles 10 are pressed inwards, the two clamping member 20 and 21 are caused to move apart in opposite directions to facilitate the clamping of the outer diameter of a C-shaped retaining ring. The clamping an, ale of the C-shaped retaining ring by the clamping rods 3 can be adjusted as required by loosening the fastening bolts 31, as illustrated in FIG. 4.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A pliers for retaining rings and snap-rings comprising a main body, a pliers head, and two clamping rods; wherein said main body comprises two handles, each handle including at a front end thereof a clamping plate with a center hole and two locating holes, said locating holes being situated on opposing sides of said center hole, said main body including an elastic element between said two handles, said elastic element urging said handles away from each other;

said pliers head comprising a first clamping member and a second clamping member each provided with a pivoting portion, said first clamping member including a projection located in said pivoting portion of said first clamping member, and said second clamping member including a through hole in said pivoting portion of said second clamping member, said projection of said first clamping member being received in said through hole of said second clamping member, said projection including an axial hole corresponding in location to said center hole of said main body, said axial hole and said center hole receiving a pivoting shaft on which said two handles of said main body are pivoted, said first clamping member and said second clamping member further including two locating holes corresponding in location to said two locating holes of said main body, a locating pin passing through each said locating hole to affix said clamping member to said handles; and wherein said clamping members include at an outer end thereof an L-shaped clamping rod with a threaded inner end and with a clamping tip thereon adapted to be inserted into retaining rings and snap-rings, each said clamping member further including at an outer end thereof multiple detentes corresponding to matching detentes on the other clamping member, said detentes forming a plurality of rod slots to receive said clamping rods, said clamping rods being secured in said rod slots by tightening a wing nut on each said threaded inner end of said clamping rods, and wherein said clamping rods may be moved to other rod slots by loosening said wing nuts, thereby releasing said clamping rods from their fixed position, placing the clamping rods in a desired rod slot, and again tightening said wing nuts, said rod slots being oriented so that an angle between said handles and said clamping rods is changed by placing said clamping rods in the different rod slots.

2. The pliers of claim 1 wherein:

the number of rod slots is three, said rod slots being formed so that said clamping rods can be affixed at three angles to said handles, said angles being 180°, 90°, and 45°.

* * * * *